United States Patent [19]

Dills

[11] 4,198,553

[45] Apr. 15, 1980

[54] COMBINATION OVEN FULLY UTILIZING THE CAPABILITY OF A LIMITED POWER SOURCE

[75] Inventor: Raymond L. Dills, Louisville, Ky.

[73] Assignee: General Electric Company, Louisville, Ky.

[21] Appl. No.: 911,569

[22] Filed: Jun. 1, 1978

[51] Int. Cl.[2] ..... H05B 9/06

[52] U.S. Cl. ..... 219/10.55 B; 219/10.55 R; 219/485; 219/486; 307/41

[58] Field of Search ..... 219/10.55 B, 10.55 E, 219/10.55 R, 484, 485, 486, 492, 493, ; 323/23, 25; 307/38, 39, 40, 41; 328/70

[56] References Cited

U.S. PATENT DOCUMENTS

| | | | |
|---|---|---|---|
| 2,637,822 | 5/1953 | Kingsley | 307/41 X |
| 3,028,472 | 4/1962 | Baird | 219/10.55 B |
| 3,081,392 | 3/1963 | Warner | 219/10.55 B |
| 3,457,430 | 7/1969 | Samuelson | 307/41 |
| 3,523,170 | 8/1970 | Boehm | 219/10.55 B |
| 3,569,656 | 3/1971 | White et al. | 219/10.55 B |
| 3,717,300 | 2/1973 | Evalds | 219/486 X |
| 3,767,894 | 10/1973 | Berger | 219/485 X |
| 3,769,520 | 10/1973 | Carrington | 307/41 |
| 4,020,358 | 4/1977 | Wyland | 307/39 |

*Primary Examiner*—Bruce A. Reynolds

*Assistant Examiner*—Philip H. Leung

*Attorney, Agent, or Firm*—Bernard J. Lacomis; Radford M. Reams

[57] ABSTRACT

A cooking oven having both microwave and electrical resistance heating means and which fully utilize the capabilities of a limited-capability power source to achieve the shortest possible cooking time. The oven has a microwave energy generating system which requires less than all of the available current when operated at its full rated power level, and an electrical resistance heating element which requires substantially all of the available current when operated at its full rated power level. The oven also has a means for at least successively energizing the microwave energy generating system and the electrical resistance heating element at their respective full rated power levels. Additionally, there is a means for energizing the electrical resistance heating element from the power source at a reduced power level when the microwave energy generating system is energized at its full rated power level. The reduced power level is selected such that the total of the currents required to operate the microwave energy generating system at its full rated power level and to operate the electrical resistance heating element at the reduced power level is no greater than and, preferably substantially equal to, the power source capability.

12 Claims, 3 Drawing Figures

COMBINATION OVEN FULLY UTILIZING THE CAPABILITY OF A LIMITED POWER SOURCE

BACKGROUND OF THE INVENTION

The present invention relates generally to a microwave oven having both microwave and electrical resistance heating capabilities and adapted for operation from a power source of limited current supplying capabilities and, more particularly, to such an oven which fully utilizes at all times the limited current supplying capabilities of the power source.

So called countertop microwave ovens have recently been introduced which are designed for operation from a 120 volt, 15 amp household branch circuit. To meet UL requirements, an appliance designed for operation from such a power source is limited to a maximum requirement of 13.5 amperes, which corresponds to approximately 1620 watts. This limited power source capability results in some particular problems.

Specifically, a typical countertop microwave oven microwave energy generating system requires a major portion of the available current. A typical microwave energy generating system comprises a magnetron which produces between 500 and 600 watts of output power at a frequency of 2450 MHz, as well as a suitable power supply for the magnetron. Such a system has an energy conversion efficiency in the order of 50%. In addition to the microwave energy generating system, a practical microwave oven includes a number of low power load devices such as lamps, blower motors, and control circuitry. Altogether, one particular commercially produced countertop microwave oven model draws approximately 11.2 RMS amperes from a 120 volt branch circuit when cooking with microwave energy alone.

In addition, due to the already limited power, supplementary electrical resistance heating elements, such as browning elements, should be operated so as to require substantially all of the available power.

As a result, for such an oven designed for operation from a 120 volt, 15 amp household branch circuit, as a practical matter the limited power available precludes the simultaneous energization of the microwave energy generating system and the supplementary electrical resistance heating units as their respective full rated power levels.

As one answer to the practical limitation on available power, countertop microwave ovens have resorted to a two-step cooking procedure whereby cooking by microwave energy is accomplished first, with the electrical resistance heating element de-energized. Next, the microwave energy source is de-energized and electrical resistance browning element is energized for the remainder of the cooking cycle.

As another answer to this practical limitation on available power, in accordance with the inventions disclosed and claimed in commonly-assigned copending application Ser. No. 911,555, filed May 31, 1978, by Raymond L. Dills; application Ser. No. 911,615, filed May 31, 1978, by Bohdan Hurko and Thomas R. Payne; and application Ser. No. 911,614, filed May 31, 1978, by Thomas R. Payne and Bohdan Hurko, effective microwave and electrical resistance heating is accomplished concurrently by various time ratio control systems which alternately energize the microwave energy generating system and the electrical resistance heating unit a plurality of times during each cooking operation. For a number of reasons described in more detail in those applications, this in effect time shares the available power and leads to superior cooking results.

With both the two-step cooking procedure previously employed and in the time sharing approaches described in the above-mentioned commonly-assigned copending applications, the current supplying capability of the power source is not utilized to the fullest extent possible. Since the current supplying capability is limited, it is desirable to utilize it to the fullest over an entire cooking operation so as to realize the shortest possible cooking time. More specifically, the electrical resistance heating units can quite easily be designed to draw substantially all the available current when energized. However, such close tailoring of the current requirements of the microwave energy generating system is generally not feasible from a practical point of view because the components of the microwave energy generating system are commercially available generally only in certain sizes. It is highly unlikely that the current requirements of a standard system would exactly coincide with the available current.

As a specific example, the exemplary microwave oven mentioned above requires approximately 11.2 RMS amperes when cooking with microwave energy. Since the microwave oven is intended for operation from a 120 volt line, fused to 15 amps, it could draw a maximum of 13.5 RMS amperes and still meet UL requirements. Thus under these conditions 2.3 RMS amperes are still available from the power source and, if not effectively utilized, a cooking operation results which is not as fast as it otherwise might be. However, during periods when the electrical resistance heating element is energized, the entire available 13.5 RMS amperes may be drawn for full utilization of the power source current-supplying capability.

SUMMARY OF THE INVENTION

Accordingly it is an object of the invention to provide a cooking oven which is adapted for operation from a power source of limited current supplying capability insufficient to supply both an electrical resistance heating element and a microwave energy generating system at their respective full rated power levels, and which fully utilizes substantially the entire current supplying capability of the power source at all times during a cooking operation.

Briefly stated and in accordance with one aspect of the invention, this and other objects are accomplished by a cooking oven including a microwave energy generating system requiring less than all of the available current when operated at its full rated power level, and an electrical resistance heating element requiring substantially all of the available current when operated at its full rated power level. The oven additionally has a means for at least successively energizing the microwave energy generating system and the electrical resistance heating element from the power source at their respective full rated power levels. Additionally, there is a means for energizing the electrical resistance heating element from the power source at a reduced power level when the microwave energy generating system is energized at its full rated power level. The reduced power level is selected such that the total of the current drawn from the source to operate the microwave energy generating system at its full rated power level and of the current drawn from the source to operate the electrical resistance heating element at the reduced power level is not greater than, and preferably substantially equal to, the power source capability.

Briefly stated and in accordance with another aspect of the invention, the reduction in power level for the electrical resistance heating element is accomplished by reducing the voltage to the heating element when the microwave energy generating system is energized.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

DESCRIPTION OF THE PREFERRED EMBODIMENT

Figure 1:
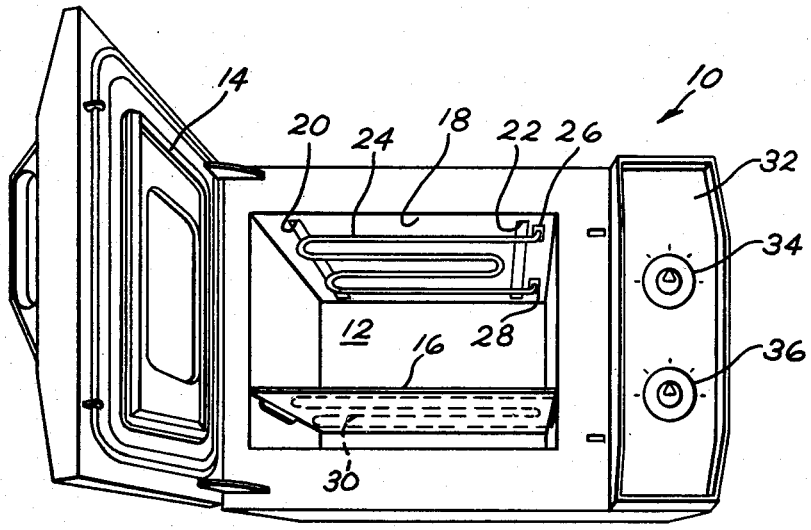
FIG. 1 is a front perspective view of a countertop microwave oven with the door open, a serpentine sheathed electrical resistance heating element located at the top of the cooking cavity, a plate-like shelf for supporting cooking utensils and a resistive film heater applied to the shelf.

Referring first to FIG. 1, there is shown a countertop microwave oven 10 including a cooking cavity generally designated 12 and an access door 14 for closing the cooking cavity 12. For supporting food or utensils placed in the oven, a shelf 16 of dielectric sheet material is provided near the bottom of the cooking cavity 12.

The top wall 18 of the cavity 12 includes a pair of apertures 20 and 22 which couple microwave energy from a waveguide system (not shown) supplied by a magnetron (not shown) into the cavity 12. It will be appreciated that the microwave feed system illustrated is exemplary only and does not form any part of the present invention. As another example, instead of a pair of apertures 20 and 22, a single larger centrally located aperture covered by a suitable heat resistance plate (not shown) which is transparent to microwave energy might be employed.

For convenience of illustration, the oven 10 of FIG. 1 has two different forms of electrical resistance heating element illustrated. However, an actual oven will typically include only one of the illustrated heating elements. Specifically, a browning element 24 comprising a sheathed electrical resistance heating unit of serpentine configuration is positioned generally adjacent to but spaced from the top wall 18 of the cavity 12. The ends 26 and 28 of the browning element 24 are suitably terminated at the top wall 18, the electrical leads (not shown) therefrom being connected to circuitry (FIG. 3) in an electrical components compartment located generally to the right of the cooking cavity 12. The other illustrated resistance heating element is a resistive film heater applied to the underside of the dielectric shelf 16 to effect direct heating thereof. Many such heaters are known in the art and may comprise a precious metal film or a tin oxide film. Resistive film heaters may be formed either by deposition on selected areas, or by etching away selected portions of a film which initially substantially covers all of one side of the plate-like shelf 16. Compared to a sheathed electrical resistance heating element such as the browning element 24, resistive film heaters such as the heater 30 have a relatively low thermal mass and therefore heat up fairly rapidly.

A control panel 32 generally to the right of the cooking cavity 12 and forming the front of the aforementioned components compartment includes an upper control 34 to enable a user of the oven 10 to select the total duration of a cooking operation, and a duty cycle control 36 to control the time ratio between the energization of the microwave energy source and the energization of the resistive heating element 24 or 30.

It will be appreciated that either of the resistive heating elements 24 or 30 may readily be designed to operate at any desired power level. For example, if 11.0 RMS amperes at 120 volts is available, by Ohms law a resistance heating element may be designed to have a resistance of 11.0 ohms to draw substantially all of the available current. Such a heating element would thus require approximately 1320 watts. It will be appreciated that, due to the various low power load devices, only 11.0 and not the entire 13.5 RMS amperes of the power source is available for the heating element.

Figure 2:
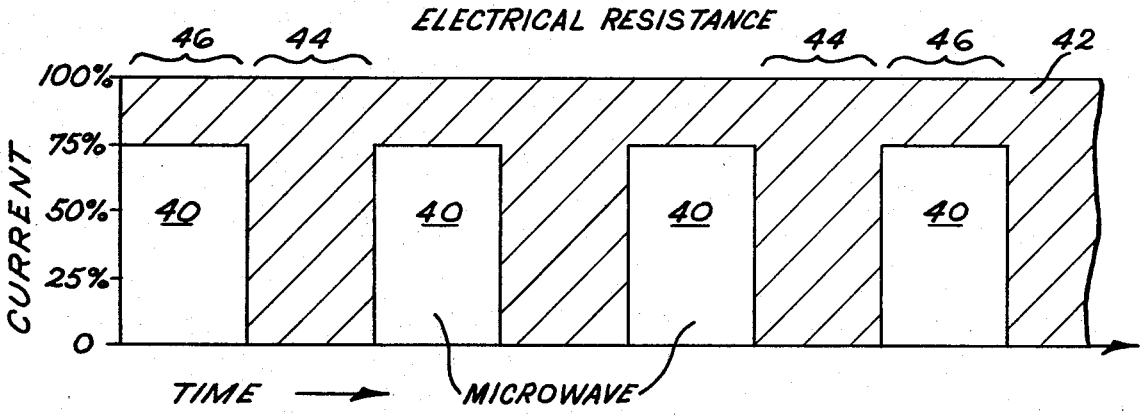
FIG. 2 is a graphical depiction of current utilization by the microwave energy generating system and the electrical resistance heating element as a function of time.

Referring now to FIG. 2, there is graphically shown as a function of time the current requirements of either of the electrical resistance heating elements 24 or 30 and of the microwave energy generating system when operated in accordance with the present invention. More specifically, the periods of energization of the microwave energy generating system are represented by unshaded blocks 40, having a height representative, in this example, of 75% of the available current. It will be appreciated that the 75% current level is an arbitrary percentage selected for the purposes of example, and that an actual microwave energy generating system will most likely require a different current. The entire shaded portion 42 of FIG. 2 represents the energization of either of the electrical resistance heating elements 24 or 30 as a function of time. During those intervals 44 when the microwave energy generating system is not energized, the electrical resistance heating element 24 or 30 is operated at its full rated power level and draws 100% of the available current from the power source.

However, during those intervals 46 when the microwave energy generating system is energized at its full rated power level, the electrical resistance heating element 24 or 30 is energized at a reduced power level, the reduced power level selected such that the total of the currents required by the microwave energy generating system operated at its full rated power level (75%) and of the current supplied to the electrical resistance heating element 24 or 30 operated at its reduced power level is substantially equal to the power source capability (100%). Thus, in this particular example the reduced power level is selected such that the electrical resistance heating element 24 or 30 draws 25% of the available current.

With the energization pattern depicted in FIG. 2, it will be apparent that the power source is utilized to its fullest throughout an entire cooking cycle. As previously mentioned, with an already limited power source this is of particular benefit in shortening the time required for a cooking operation.

It will of course be appreciated that the reduced power level may be selected such that the current drawn from the source to operate the heating element 24 or 30 is less than the additional current which is available, but that the full benefits of the invention would not be realized. In accordance with the invention, any current may be drawn to supply the heater 24 or 30 at the reduced power level, so long as the total current drawn is no greater than the power source capability.

In FIG. 2, the resistance heating element and the microwave energy generating system are alternately energized at their respective full rated power levels a plurality of times during a cooking operation. However it will be apparent that, for a two-step cooking operation, they each need to be so energized only once. For such "two-step" operation, the respective heating means are successively energized. It will also be appreciated, that during portions of a longer alternate energization pattern, the two heating means are also successively energized.

Figure 3:
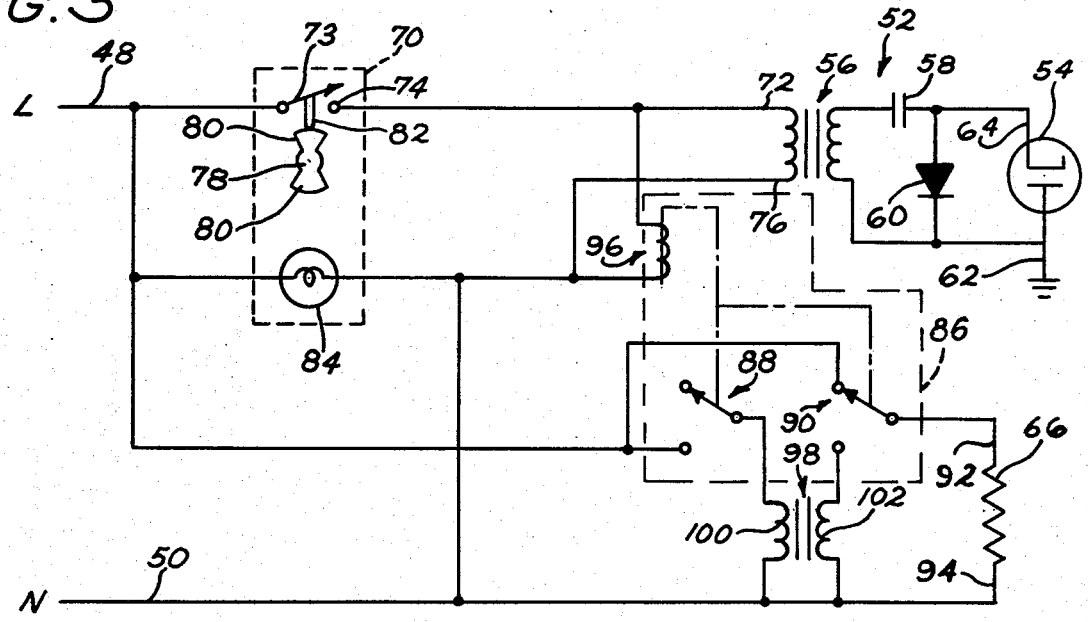
FIG. 3 is a schematic diagram of a portion of an electrical circuit embodying the present invention.

Referring lastly to FIG. 3, there is shown one exemplary electrical circuit for operating the oven 10 to produce the energization pattern of FIG. 2. In FIG. 3, L and N conductors 48 and 50 are connected by conventional circuitry (not shown) including the cooking operation duration control 34 (FIG. 1) so as to be energized from a 120 volt, 15 ampere household branch circuit during a cooking operation. It will be apparent that the duration of a cooking operation could be determined either by time or by temperature, as is known in the art. Omitted from FIG. 3 are various other components conventionally included in microwave ovens, such as a main power switch or relay and various safety interlock switches.

In FIG. 3, there are two ultimate load devices to be energized from the L and N conductors 48 and 50. The first load device is a microwave energy generating system 52 comprising a permanent magnet magnetron connected to a power supply comprising a ferroresonant transformer 56 and a half-wave voltage doubler including a series capacitor 58 and a rectifier 60 connected across the magnetron anode and cathode terminals 62 and 64 and oppositely poled with respect thereto. The second ultimate load device depicted is a resistive heating element 66 which is representative of either of the heating elements 24 or 30 of FIG. 1. While only a single heating element 66 is shown, it will be appreciated that it may comprise a plurality of individual heating elements.

In order to periodically energize the microwave energy generating system 52 from the power source at its full rated power level a percentage timer, shown in highly representative form at 70, is interposed in series with the L conductor 48 and the upper terminal 72 of the power transformer 56. More specifically, the representative timer includes a cam operated switch 73, and the output terminal 74 of the switch 73 is connected to the transformer terminal 72. For a complete circuit, the lower terminal 76 of the transformer 56 is connected to the N power source conductor 50.

The representative timer 70 comprises, in addition to the switch 73, a rotating cam 78 having a pair of protrusions 80 which open the switch 73 as illustrated through a link 82. The cam 78 is driven by a timing motor 84.

The periodic energization of the microwave energy generating system effected by the representative timer 70 may occur once during a cooking operation, such as in the two-step cooking procedure referred to in the Background of the Invention, or may be a plurality of times during a cooking operation as is disclosed in the above-mentioned copending applications concerning time sharing approaches. It will be appreciated that the timer 70 may take various forms, either electrical or electromechanical. One example of a suitable electromechanical variable percentage timer is disclosed in U.S. Pat. No. 4,001,529 issued to Mahon, the entire disclosure of which is hereby incorporated by reference.

FIG. 3 additionally depicts a means for energizing the electrical resistance heating element 66 at its full rated power level when the microwave energy generating system 52 is not energized. Specifically, there is a DPDT relay 86 having its contacts 88 and 90 arranged to directly connect the upper terminal 92 of the representative heating element 66 through the switch section 70 to the L power source conductor 48 when the relay 86 is not activated. For a complete circuit, the lower terminal 94 of the representative heating element 66 is directly connected to the N power source conductor 50.

For energizing the representative electrical resistance heating element 66 at a reduced power level when the microwave energy generating system is energized at its full rated power level, the coil 96 of the relay 86 is connected in parallel with the terminals 72 and 76 of the power transformer 56 so that the relay 86 is activated whenever the microwave energy generating system 52 is energized by closing of the switch 73. Additionally, a voltage stepdown transformer 98 has its primary winding 100 connected such that it is energized through the relay contacts 88 from the L power source conductor 48 when the relay 86 is activated, and its secondary winding 102 connected to supply the representative heating element 66 through the relay contact 90 when the relay 86 is activated.

The voltage produced by the secondary winding 102 is selected to operate the representative resistance heating element 66 at a reduced power level such that the current drawn from the source to operate the heating element 66 at the reduced power level, when added to the current drawn from the source to operate the microwave energy generating system 52, substantially equals the RMS current supplying capability of the power source. As a specific illustration, the example referred to above where 2.3 RMS amperes is still available from the power source even when the microwave energy generating system is energized at its full rated power level will be further considered. In this case, it is desired that 2.3 RMS amperes be drawn from the L and N conductors 48 and 50 to operate the heating element 66 through the transformer 98. Assuming the simplification that the transformer 98 is 100% efficient, (120 volts) (2.3) amperes)=276 watts must be coupled from the primary winding 100 to the secondary winding 102. The resistance of the heating element 66 was previously determined to be 11.0 ohms. For 276 watts to be delivered to a 11.0 ohm resistive load requires a voltage, $V=\sqrt{(276 \text{ watts})(11.0 \text{ ohms})}=55.1$ volts. Accordingly, the voltage stepdown transformer 98, and more particularly the secondary winding 102 thereof, is sized to deliver 55.1 RMS volts. Of course if the full benefits of the invention are not desired, for example as a compromise to permit the use of a standard voltage transformer, a transformer with a lower secondary voltage may be employed.

While the exemplary circuit of FIG. 3 uses a conventional transformer to reduce the voltage to the heating element 66 to effect reduced power operation thereof, it would be appreciated that an autotransformer may as well be utilized. Additionally, methods other than reducing the voltage to the representative heating element 66 may be employed. For example, the heating element 66 may comprise a number of separate elements connected electrically in parallel for full power operation, and selectively switched in series for reduced power operation. As another alternative, the system disclosed and claimed in a commonly assigned copending application Ser. No. 911,544, filed May 31, 1978, by Thomas R. Payne and entitled "Combination Oven Fully Utilizing The Current-Supplying Capability of a Power Source" may be employed.

It will be apparent therefore that the present invention provides a means for utilizing the current supplying capability of a limited power source to the fullest extent in a countertop microwave oven having both microwave cooking and electrical resistance heating capability.

While specific embodiments of the invention have been illustrated and described herein, it is realized that modifications and changes will occur to those skilled in the art. It is therefore to be understood that the appended claims are intended to cover all such modifications and changes as fall within the true spirit and scope of the invention.

What is claimed is:

1. A cooking oven which has both microwave and electrical resistance heating means, which is adapted for operation from a power source of limited current-supplying capability insufficient to concurrently supply both heating means at their respective full rated power levels, and which comprises:

said microwave heating means including a microwave energy generating system requiring less than all of the available current when operated at its full rated power level;

said resistance heating means including an electrical resistance heating element requiring substantially all of the available current when operated at its full rated power level;

means for successively energizing said microwave energy generating system and said electrical resistance heating element from the power source at their respective full rated power levels; and means for energizing said electrical resistance heating element from the power source at a reduced power level when said microwave energy generating system is energized at its full rated power level, the reduced power level selected such that the total of the current drawn from the source to operate said microwave energy generating system at its full rated power level and of the current drawn from the source to operate said electrical resistance heating element at the reduced power level is no greater than to the power source capability.

2. A cooking oven according to claim 1, wherein said means for energizing said electrical resistance heating element at a reduced power level reduces the voltage to said heating element.

3. A cooking oven according to claim 1, wherein said electrical resistance heating element has a relatively low thermal mass.

4. A cooking oven according to claim 3, wherein said electrical resistance heating element comprises a resistive film heater.

5. A cooking oven according to claim 1, wherein the current drawn from the source to operate said electrical resistance heating element at the reduced power level is substantially equal to the power source capability.

6. A cooking oven according to claim 5, wherein said means for energizing said electrical resistance heating element at a reduced power level reduces the voltage to said heating element.

7. A cooking oven which has both microwave and electrical resistance heating means, which is adapted for operation from a power source of limited current-supplying capability insufficient to concurrently supply both heating means at their respective full rated power levels, and which comprises:

said microwave heating means including a microwave energy generating system requiring less than all of the available current when operated at its full rated power level;

said resistance heating means including an electrical resistance heating element requiring substantially all of the available current when operated at its full rated power level;

means for alternatively energizing said microwave energy generating system and said electrical resistance heating element from the power source at their respective full rated power levels; and means for energizing said electrical resistance heating element from the power source at a reduced power level when said microwave energy generating system is energized at its full rated power level, the reduced power level selected such that the total of the current drawn from the source to operate said microwave energy generating system at its full rated power level and of the current drawn from the source to operate said electrical resistance heating element at the reduced power level is no greater than to the power source capability.

8. A cooking oven according to claim 7, wherein said means for energizing said electrical resistance heating element at a reduced power level reduces the voltage to said heating element.

9. A cooking oven according to claim 7, wherein said electrical resistance heating element has a relatively low thermal mass.

10. A cooking oven according to claim 9, wherein said electrical resistance heating element comprises a resistive film heater.

11. A cooking oven according to claim 7, wherein the current drawn from the source to operate said electrical resistance heating element at the reduced power level is substantially equal to the power source capability.

12. A cooking oven according to claim 11, wherein said means for energizing said electrical resistance heating element at a reduced power level reduces the voltage to said heating element.

* * * * *